US009656845B2

(12) United States Patent
Dittus et al.

(10) Patent No.: US 9,656,845 B2
(45) Date of Patent: May 23, 2017

(54) AERIAL LIFT WITH SECURE CONTROL CONSOLE

(71) Applicant: HAULOTTE GROUP, L 'Horme (FR)

(72) Inventors: Sebastian Dittus, Vaugneray (FR); Christophe Carrillo, Saint Martin la Plaine (FR)

(73) Assignee: HAULOTTE GROUP, L'Horme (FR)

( * ) Notice: Subject to any disclaimer, the term of this patent is extended or adjusted under 35 U.S.C. 154(b) by 0 days.

(21) Appl. No.: 14/900,864

(22) PCT Filed: Jun. 24, 2014

(86) PCT No.: PCT/EP2014/063280

§ 371 (c)(1),
(2) Date: Dec. 22, 2015

(87) PCT Pub. No.: WO2014/206982

PCT Pub. Date: Dec. 31, 2014

(65) Prior Publication Data

US 2016/0137471 A1 May 19, 2016

(30) Foreign Application Priority Data

Jun. 25, 2013 (FR) ..... 13 56056

(51) Int. Cl.
*B66F 17/00* (2006.01)
*B66F 11/04* (2006.01)

(52) U.S. Cl.
CPC ..... *B66F 17/006* (2013.01); *B66F 11/044* (2013.01)

(58) Field of Classification Search
CPC ..... B66F 17/00; B66F 17/003; B66F 17/006; B66F 11/00; B66F 11/04; B66F 11/042; B66F 11/044; B66F 11/046; B66F 11/048
See application file for complete search history.

(56) References Cited

U.S. PATENT DOCUMENTS

2014/0332314 A1 11/2014 Carrillo et al.

FOREIGN PATENT DOCUMENTS

CN 201665512 U 12/2010
FR 2 984 293 A1 6/2013
(Continued)

OTHER PUBLICATIONS
International Search Report, dated Sep. 18, 2014, from corresponding PCT application.
(Continued)

*Primary Examiner* — Alvin Chin-Shue
*Assistant Examiner* — Shiref Mekhaeil
(74) *Attorney, Agent, or Firm* — Young & Thompson

(57) ABSTRACT

The aerial lift includes a chassis equipped with elements for moving over the ground surface, a mast, a platform (10) supported by the mast, a control console mounted on the platform and including elements for controlling movements of the platform, and a safety bar mounted so as to tilt or slide relative to the console, designed to control the operation of the control elements. This safety bar is intended to assume a first, idle position where the safety bar does not prevent the operation of the control elements, and a second position, wherein the safety bar inhibits the operation of the control elements. When it tilts or slides between the first position and the second position, the safety bar assumes an intermediate position where it does not prevent the operation of the control elements and wherein it activates warning elements.

11 Claims, 6 Drawing Sheets

(56) References Cited

FOREIGN PATENT DOCUMENTS

Figure 1:
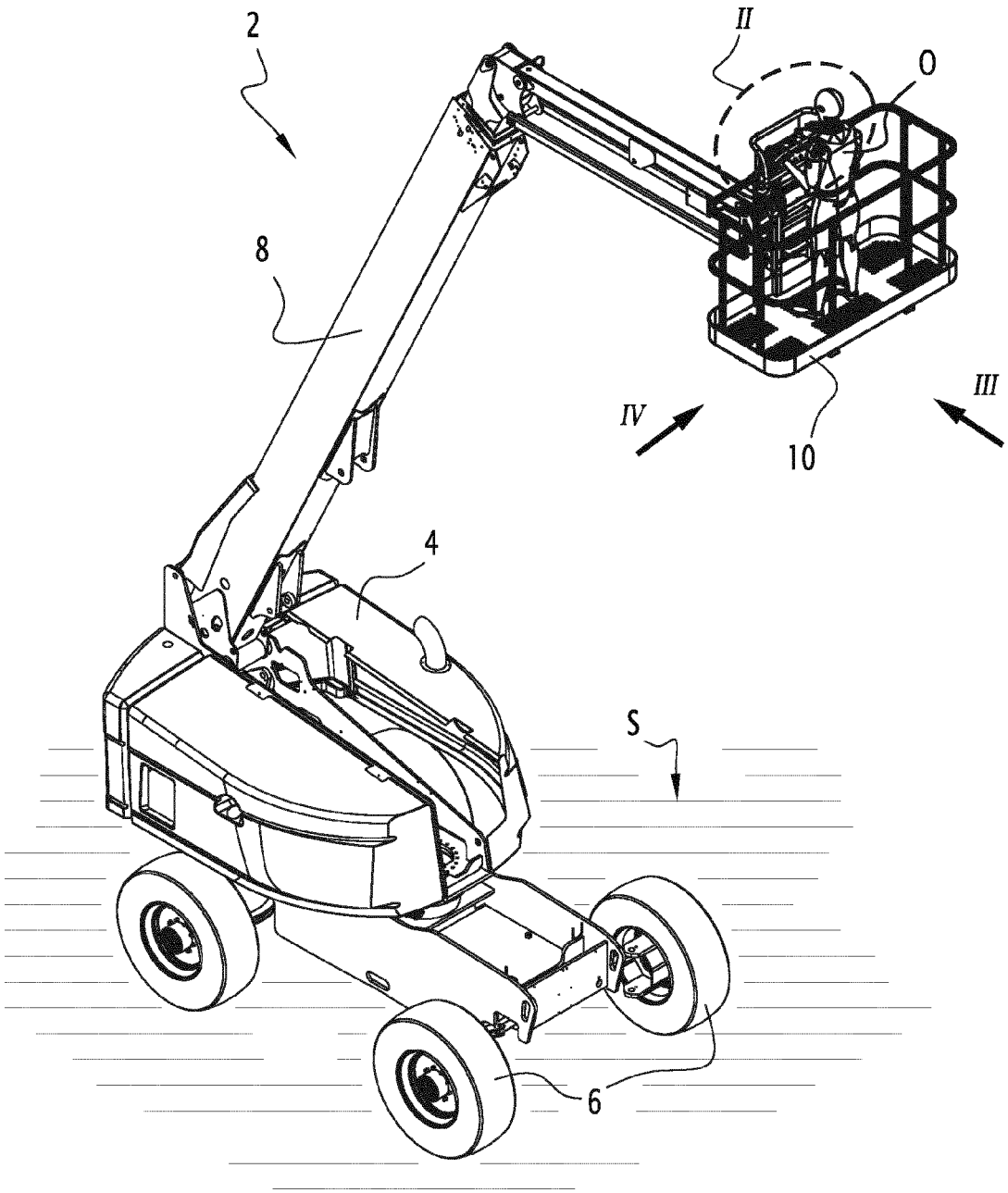

| | | | |
|---|---|---|---|
| GB | 2 481 709 | A | 1/2012 |
| JP | S64 12100 | U | 1/1989 |
| JP | 2001 226097 | A1 | 8/2001 |
| WO | 2009/037429 | A1 | 3/2009 |
| WO | 2012/088091 | A1 | 6/2012 |

OTHER PUBLICATIONS

FR Search Report, dated Mar. 3, 2014, from corresponding FR application.

AERIAL LIFT WITH SECURE CONTROL CONSOLE

The invention relates to an aerial lift or movable aerial platform for personnel allowing an operator to work at heights.

Such an aerial lift most often comprises a chassis that is equipped with means for moving over the ground surface, such as wheels or treads. An aerial lift also comprises a mast supporting a platform provided with means for raising the latter relative to the chassis. These lift means generally comprise one or more jacks for deploying the mast controlled by control means integrated into a control console.

In order to prevent the operator from being crushed by an obstacle when raising the platform, certain control consoles are equipped with a safety bar that is mounted tilting or sliding on the console and that is used to control the operation of the means for controlling the movement of the platform. Indeed, when an operator who is not paying attention is struck by an obstacle, the operator is pressed against the control console and, by his movement, causes the security bar to tilt or slide. After a certain travel, the safety bar inhibits the operation of the control means such that all movements of the platform are stopped. This safety bar therefore acts as a stop button that is actuated mechanically during a collision between the operator and an obstacle.

Different safety bars are known from the prior art, in particular JP-U-64 12100 and WO-A-2009/037429, each disclosing an aerial lift platform that is suitable for work at heights and that is provided with means for controlling the movement of the platform. These control means are integrated into a console on which a safety bar is mounted tilting. The application of a force on the safety bar, in particular due to the collision with an obstacle, triggers a contactor ensuring the complete stop of the movement of the platforms.

In JP-U-64 12100, tilting the security bar causes an abrupt shutoff of all movements of the platform in order to limit crushing of the operator. However, an operator who is not trained or who is not paying attention may press on the safety bar during the movement of the platform even though no danger is present. In this case, the movement of the platform stops abruptly, which may cause the operator to lose balance and cause injuries or even falls.

In response to this problem, the platform disclosed in WO-A-2009/037429 incorporates a spring that is inserted between the console and the safety bar and that is greatly compressed so as to oppose the tilting of the bar. It thus for example prevents the bar from moving if the force applied is below a predetermined value. It is therefore necessary for the operator to experience a high thrust force to trigger the contactor. In practice, the operator is often crushed by the obstacle even before the cutoff occurs.

Some control consoles, like that integrated into the platform disclosed in GB-A-2,481,709, are equipped with an electronic module in which a filter is provided for the signal emitted during tilting of the safety bar. This filter serves, similarly to a retarder, to prevent the emergency stop of the platform until a certain amount of time has passed. Thus, if an operator presses on the safety bar accidentally and for a short length of time, the platform does not enter the emergency stop mode. However, if the operator does not realize that he is pressing on the bar, the platform stops abruptly, which may surprise the operator. Furthermore, using this type of solution makes the control electronics of the platform more complicated.

The invention more particularly aims to resolve these drawbacks, by proposing an aerial lift that ensures better operator safety during work at heights.

To that end, the invention relates to an aerial lift comprising a chassis equipped with means for moving over the ground surface, a mast, a platform supported by the mast, a control console mounted on the platform and comprising means for controlling movements of the platform, and a safety bar mounted so as to tilt or slide relative to the console, designed to control the operation of the control means, and provided to assume a first idle position where the safety bar does not prevent the operation of the control means, and a second position where the safety bar inhibits the operation of the control means. According to the invention, when the safety bar tilts or slides between the first position and the second position, the safety bar assumes an intermediate position where it does not prevent the operation of the control means and where it activates warning means.

Owing to the invention, if the operator inadvertently presses lightly on the safety bar, for example with his chest, the safety bar tilts into the intermediate position and activates the warning means, which notify the operator that if he continues to press on the safety bar, all movements of the platform will be cut. In this intermediate position, the means for controlling the movement of the platform are not inhibited, which means that the operator does not risk being surprised by an abrupt stop of the movement of the platform. As a result, operator fall risks are greatly reduced.

According to advantageous optional aspects of the invention, an aerial lift may include one or more of the following features considered in any technically possible combination, and in which:

- It includes at least one signal member, in particular three signal lights each activated in a position of the safety bar.
- A first signal light in a first color is activated when the safety bar is in its first position, a second signal light in a second color is activated when the safety bar is in its second position, and a third signal light in a third color, belonging to the warning means, is activated when the safety bar is in its intermediate position.
- The signal lights are integrated into the safety bar.
- The safety bar is made at least partially from a transparent or translucent material, in particular polymethyl methacrylate.
- The signal lights are integrated into the control console.
- The warning means comprise an audible warning, suitable for emitting a predetermined sound when the safety bar is in the intermediate position.
- The movements of the platform are slowed when the safety bar is in its intermediate position.
- The safety bar is U-shaped and in that the tilting or sliding of the safety bar between its first position and its second position is done toward the outside of the platform relative to the location of an operator in position to manipulate the control members.
- It comprises means for detecting the tilting or sliding of the safety bar that controls the operation of the control means.

Figure 2:
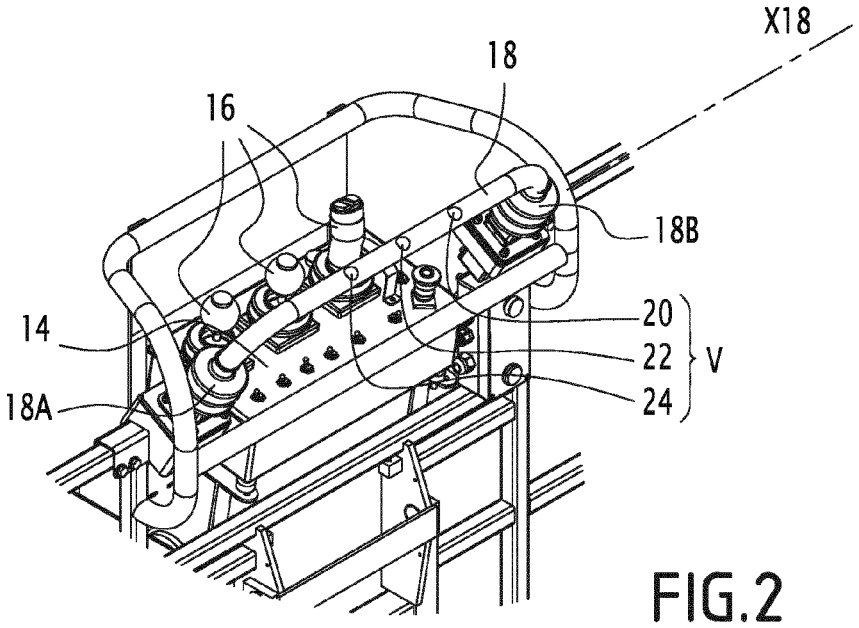
Figure 3:
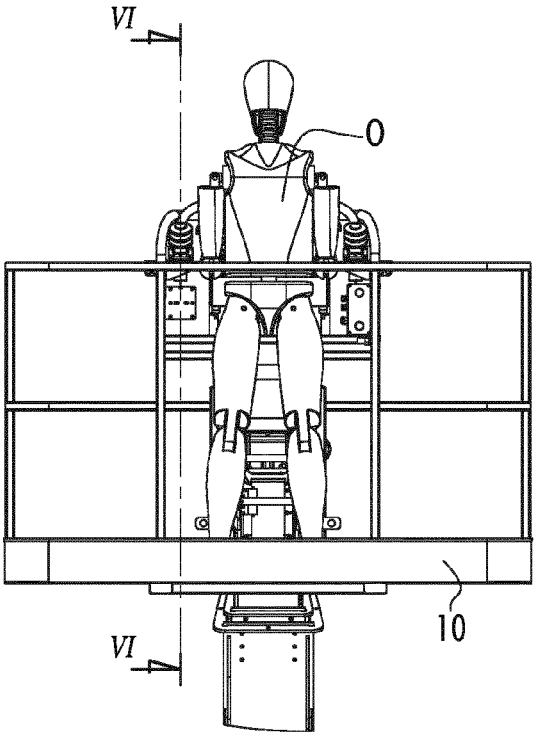
Figure 4:
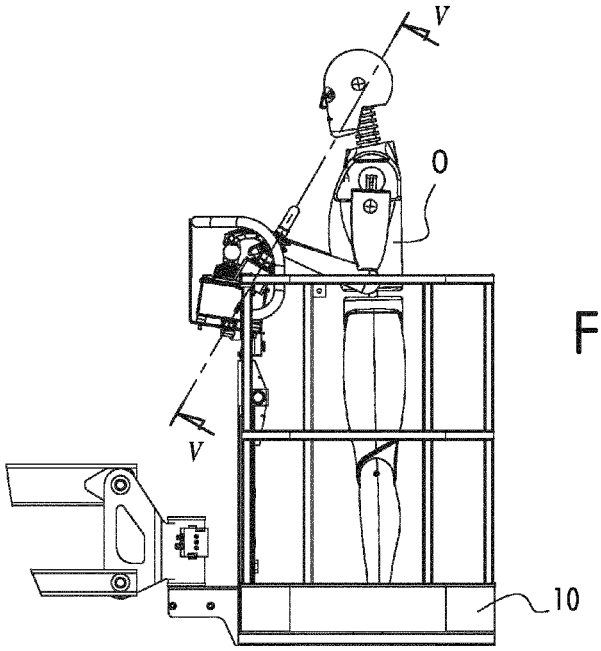
Figure 5:
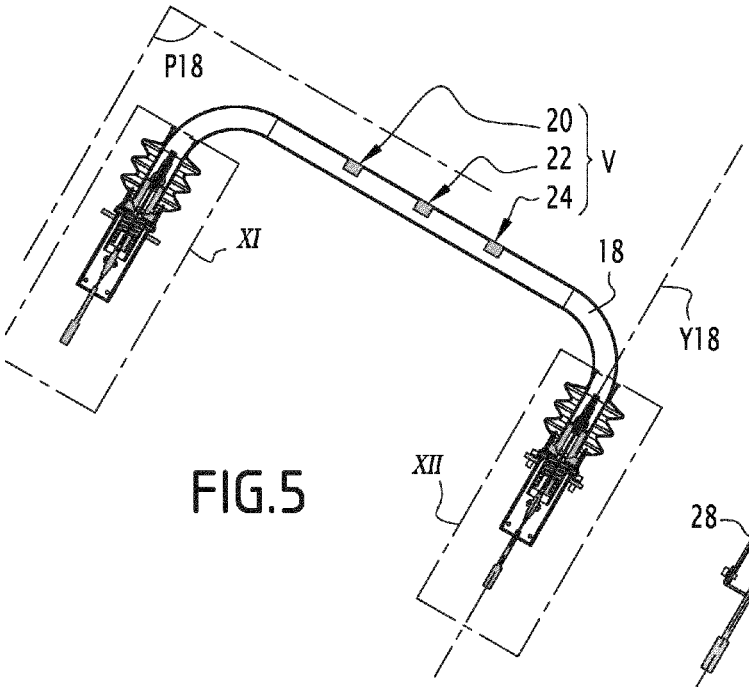
Figure 6:
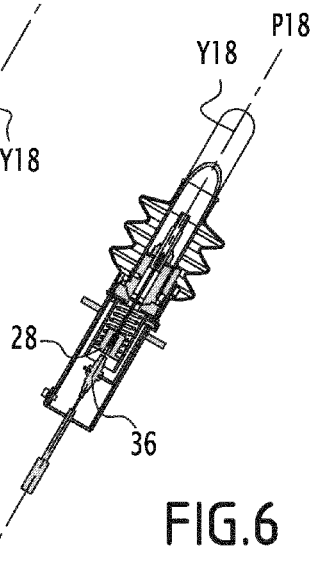
Figure 7:
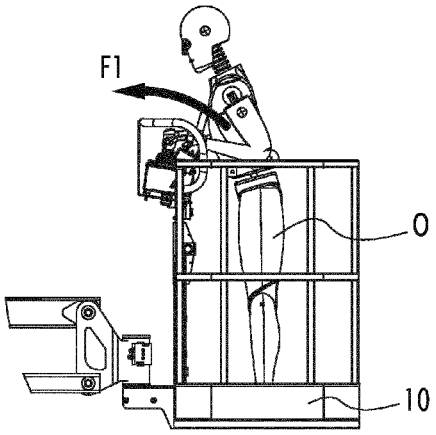
Figure 8:
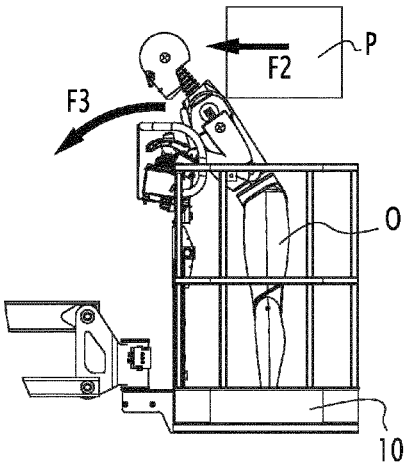
Figure 9:
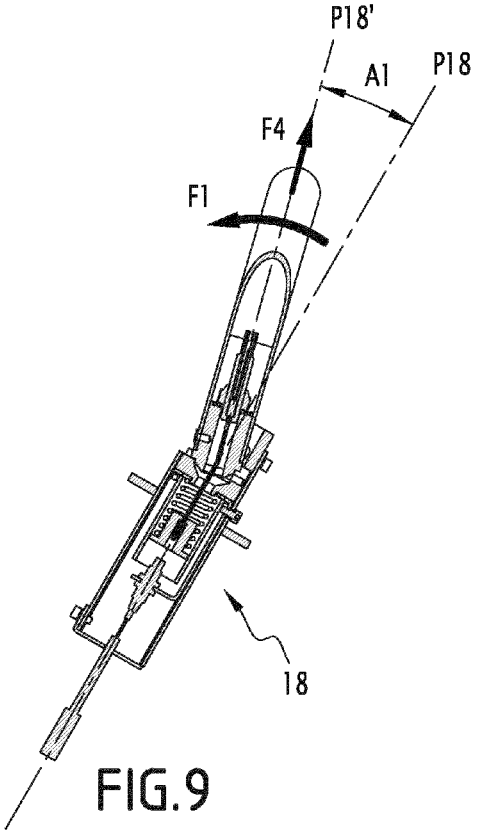
Figure 10:
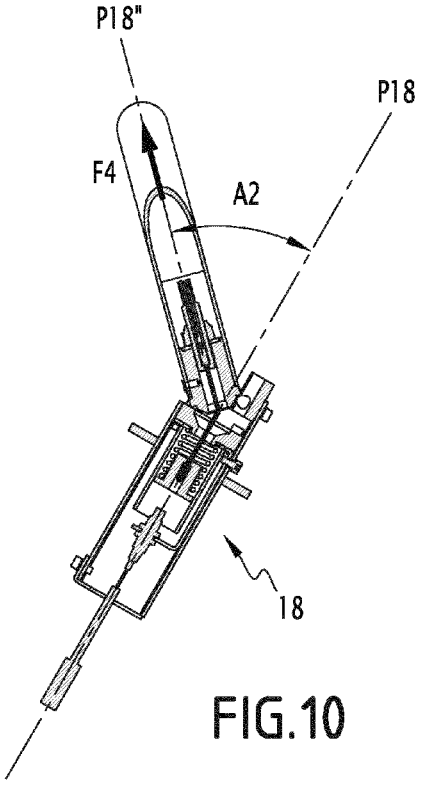
Figure 11:
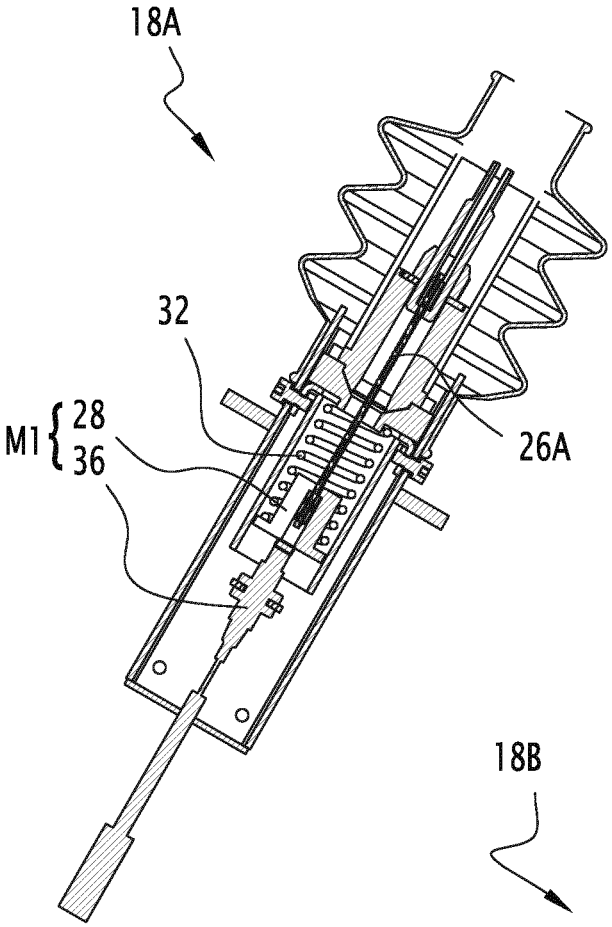
Figure 12:
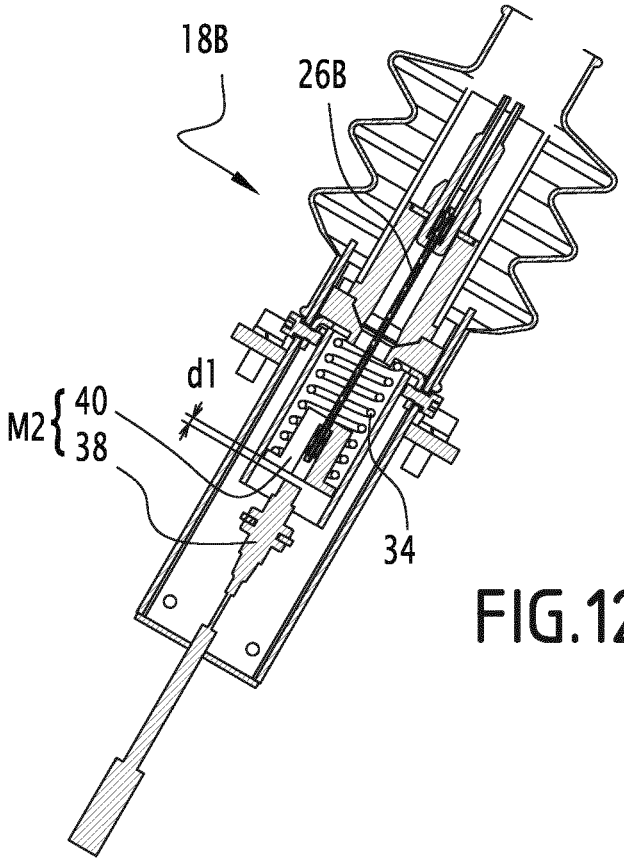
Figure 13:
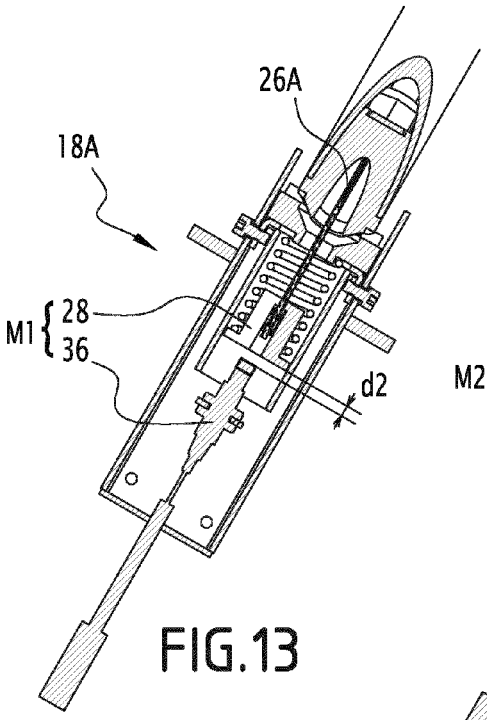
Figure 14:
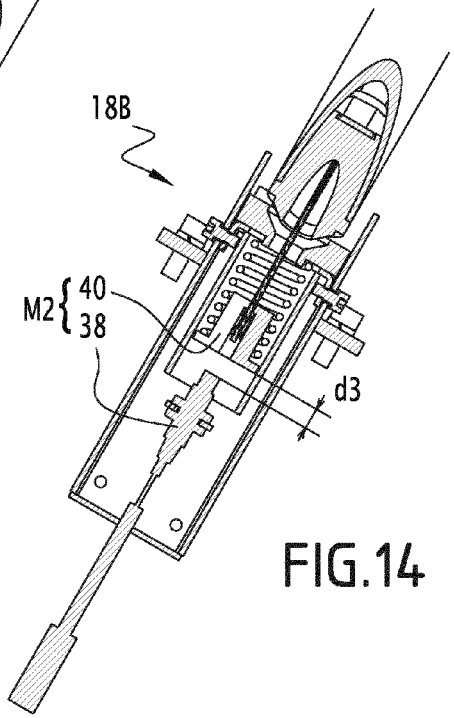
Figure 15:
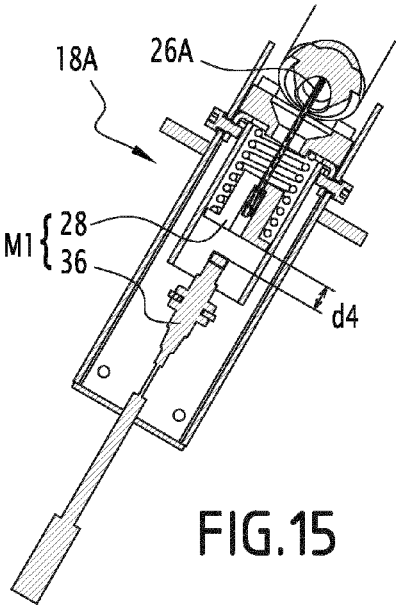
Figure 16:
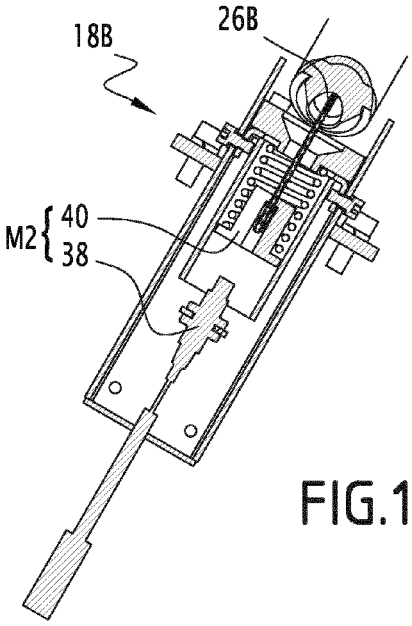

The invention will be better understood, and other advantages thereof will appear more clearly, in light of the following description of one embodiment of an aerial lift according to its principle, provided solely as an example and done in reference to the appended drawings, in which:

FIG. 1 is a perspective view of an aerial lift according to the invention transporting an operator, FIG. 2 is a detail view of circle 2 in FIG. 1, without the operator, FIG. 3 is a partial view along arrow III of FIG. 1, FIG. 4 is a partial view along arrow IV of FIG. 1, FIG. 5 is an enlarged partial view along line V-V in FIG. 4, FIG. 6 is a larger scale partial sectional view along line VI-Vi of FIG. 3, FIG. 7 is a view similar to FIG. 4, showing a configuration where the operator inadvertently presses on the safety bar slightly with his chest, FIG. 8 is a view similar to FIG. 4, showing a configuration during a collision between the operator and an obstacle, FIGS. 9 and 10 are sectional views similar to FIG. 6, showing the position of the safety bar in the configuration of FIGS. 7 and 8, respectively, FIG. 11 is an enlarged view of box 11 of FIG. 5, FIG. 12 is an enlarged view of box 12 of FIG. 5, FIGS. 13 and 15 are sectional views similar to FIG. 11, in the configurations of FIGS. 7 and 8, respectively, and FIGS. 14 and 16 are sectional views similar to FIG. 12, in the configurations of FIGS. 7 and 8, respectively.

FIG. 1 shows an aerial lift 2 used to transport an operator O at heights. This aerial lift 2 comprises a chassis 4 equipped with means for moving over the ground surface S. In the present case, these movement means are wheels 6, but they can also be treads. A mast 8 supporting a platform 10 is mounted on the chassis 4. The operator O positioned on the platform manipulates a console 14 fixed on a wall of the platform 10 and comprising several buttons and levers 16 that together form means for controlling the movement of the platform 10. The means 16 control wheels 6 and the mast 8, which makes it possible to move the lift 2 relative to the ground and the platform 10 relative to the chassis 4.

A safety bar 18 is mounted articulated on the console 14. This safety bar 18 is hollow and U-shaped, each branch of the U being connected to the console 14. References 18A and 18B denote the two ends of the safety bar 18, these two ends being connected in a tilting manner to the console 14. More specifically, by denoting an axis X18 passing through the ends 18A and 18B, the safety bar 18 is able to tilt around the axis X18.

In practice, to manipulate the means 16 for controlling the movement of the platform 10, the operator O passes his hands below the safety bar 18. The safety bar 18 is an opaque metal bar in which three holes are arranged for receiving lighted signal members V. These signal members are the signal lights V, which are respectively denoted 20, 22 and 24. The signal light 20 is green, the signal light 22 is orange and the signal light 24 is red.

In the configuration of FIGS. 3 to 6, the safety bar 18 is in a first position, or idle position, which means that the operator O can manipulate the control means 16 freely to move the platform 10. The green indicator light 20 is then lit.

As shown in FIGS. 5 and 6, the safety bar 18 is globally contained in a plane P18 and comprises, at its two ends 18A and 18B, detection means M1 and M2 for detecting the tilting of the safety bar 18. These detection means M1 and M2 comprise Hall effect proximity sensors 36 and 38 that monitor the operation of the control means 16 and that are provided to detect the presence of a metal end-piece at a distance smaller than 4 mm in a direction Y18 perpendicular to the axis X18 in the plane P18. These are therefore binary-type sensors. In the case at hand, metal end-pieces 28 and 40 are attached to cables respectively numbered 26A and 26B. The cables 26A and 26B are wound around a shaft substantially parallel to the axis X18 during tilting of the safety bar 18, which drives the movement of the metal end-pieces 28 and 40 along the axis Y18, relative to the sensors 36 and 38. The signals emitted by the sensors 36 and 38 change value depending on the presence or absence of a metal body in the measuring field. Thus, a movement of the metal end-pieces 28 and 40 causes a change in the signal emitted by the sensors 36 and 38 and, if this movement causes the metal end-pieces 28 and 40 to leave the field, the activation of the sensor. Springs 32 and 34 respectively bear on the metal end-pieces 28 and 40 such that the latter are kept elastically charged along the axis Y18 and respectively toward the sensors 36 and 38. The metal end-pieces 28 and 40 are hollow to facilitate their attachment to the cables 26A and 26B and have a stepped shape suitable for bearing on one end of the springs 32 and 34.

FIG. 7 shows a situation where the operator O is accidentally bearing on the safety bar 18. This bearing is shown in FIG. 7 by an arrow F1 and causes the safety bar to tilt around the axis X18 until it reaches an intermediate position shown in FIG. 9, where it is slightly tilted relative to its idle state, shown in FIG. 6. This occurs in particular when the operator O grips or presses with his chest on the safety bar 18 inadvertently. Reference P18' then denotes a plane in which the safety bar 18 is contained in this intermediate position. The plane P18' is inclined relative to the plane P18 by an angle A1. In practice, the angle A1 is comprised between 5° and 20°, in particular equal to 15°. In this intermediate position, the safety bar 18 does not prevent the operation of the control means 16. In other words, the manipulation of the control means 16 also involves moving the platform 10.

However, warning means, which in the example consist of the indicator light 22, warn the operator O that the safety bar 18 has begun to tilt and that if this movement continues, it will inhibit the operation of the control means 16, thus stopping any movement of the platform 10. The orange indicator light 22 is then lit.

Thus, if the operator O inadvertently grips or presses slightly with his chest on the safety bar 18, the indicator light 22 lights up and indicates a potential danger. The operator O then knows that he must release the pressure on the safety bar 18 to prevent a complete stop of the platform 10. Indeed, operator losses of balance and falls are often due to the fact that the operator is surprised by the sudden stop of the movement of the platform 10.

Tilting the safety bar 18 between a first position, or idle position, and the intermediate position causes a traction force on the cables 26A and 26B. This traction force, shown by an arrow F4 in FIGS. 9 and 10, drives the metal end-pieces 28 and 40 to move against the action of the springs 32 and 34 and in a direction opposite the sensors 36 and 38. In other words, the metal end-pieces 28 and 40 move away from the sensors 36 and 38. The springs 32 and 34 and the tension of the cables 26A and 26B oppose almost no resistance to the tilting of the bar 18, such that unlike the safety bars known from the prior art, there is no need to apply a significant force to move the bar 18. In other words, the force necessary to move the bar 18 is very small, unlike the safety bars according to the prior art, where it is necessary to apply a significant force, for example to compress a spring directly opposing the movement of the bar. Thus, in the lifts of the prior art, the application of a force from the obstacle on the operator often means that the operator is injured before triggering the emergency stop. Yet when a collision occurs, the safety bar 18 of the lift according to the invention moves more quickly, which causes the emergency stop without the operator O being crushed first.

When idle, and as shown in FIG. 11, the distance between the sensor 36 and the metal end-piece 28 is smaller than 1 mm, which is why it is not shown in FIG. 11, and the distance d1, shown in FIG. 12, between the sensor 38 and the metal end-piece 40 is greater than 2 mm. The detection means M1 and M2 are provided to be activated when the distance between the sensor and the moving conductive part exceeds 4 mm. Thus, when idle, the two detection means M1 and M2 are inactive.

However, in the intermediate position of the safety bar in FIGS. 13 and 14, a distance d3, shown in FIG. 14, hollows out between the sensor 38 and the metal end-piece 40 at the detection means M2. This distance d3 being larger than 4 mm, the detection means M2 therefore activates the warning means, i.e., the orange indicator light 22, which lights up. The detection means M2 is therefore a warning device. Furthermore, the traction force F3 of the cable 26 creates a distance d2, shown in FIG. 13, at the end 18A of the safety bar 18 between the sensor 36 and the metal end-piece 28. This distance d2 is, however, smaller than 4 mm, which means that the detection means M1 is not activated and the safety bar 18 does not prevent the operation of the control means 16. In other words, it is still possible for the platform 20 to move.

As shown in FIG. 8, when the operator O is struck in the back by a beam P, he is pressed against the console 14 as shown by arrow F2. The operator O then mechanically tilts the safety bar 18 around the axis X18 and in a direction F3 that is oriented toward the outside of the platform 10 relative to location of the operator. In other words, when one looks at the operator O from his left in FIG. 8, he drives the safety bar 18 to tilt it in the counterclockwise direction. This has the advantage that the operator can extricate himself from the beam P, since the safety bar does not oppose the downward movement of the operator O, i.e., toward the floor of the platform 10. The tilting of the safety bar 18 is better visible in FIG. 9. In FIGS. 8 and 10, the safety bar 18 is in a second position, or stop position, in which it inhibits the operation of the control means 16, i.e., they no longer drive the movement of the platform 10. In other words, an emergency stop signal is sent by the detection means M1 to an electronic control unit (not shown), in order to block the movement of the platform 10. The safety bar 18 therefore operates as a stop button, which involves a sudden stop of the platform 10 when it is activated. This sudden stop is for example obtained by cutting the power to the deployment jacks for the mast 8 and the driving means of the wheels 6. The detection means M1 is therefore a means for detecting the activation of a safety device.

As shown in FIG. 10, the safety bar 18 is then contained in a plane P18" that marks an angle A2 with the plane P18 in which the safety bar 18 is contained when idle. In practice, the angle A2 is comprised between 20° and 60°, in particular equal to 30°. As shown in FIG. 15, the sensor 36 and the metal end-piece 28 of the first detection means M1 are then separated by a distance d4 greater than 4 mm. Thus, the detection means M1 send an emergency stop signal to the electronic control unit of the lift 2 so that the operator O is not crushed between the beam P and the control means 16. In this position, the red indicator light 24 is lit.

Tilting by an angle A1 makes it possible, from the idle position, to reach the intermediate position, while tilting by an angle A2 makes it possible, from the idle position, to reach the stop position where the platform 10 is immobilized.

The safety bar 18 can continue to tilt past the angle A2. In this case, the tension of the cables 26A and 26B increases the distance between the sensors 36 and 38 and the metal end-pieces 28 and 40. In this position, the detection means M1 send an emergency stop signal and the platform 10 is immobilized. Thus, the gradual tilting of the safety bar 18 causes a warning, then a stop order. Being able to continue to tilt the safety bar 18, even after the emergency stop is activated, allows the operator to set the bar 18 down against the console and free himself from the contact zone with the beam P. Thus, unlike the aerial lifts of the prior art, the safety bar does not injure the operator by keeping him against the obstacle. In other words, the safety bar 18 accompanies the movement of the operator O to prevent him from being crushed between the bar 18 and the beam P.

If the operator O releases the force applied on the safety bar 18, it then returns to its idle position owing to the action of the springs 32 and 34. Indeed, the springs 32 and 34 tend to pull the cables 26A and 26B so as to bring the metal end-pieces 28 and 40 closer to the sensor 36 and 38 of the detection means M1 and M2, respectively. Furthermore, the springs 32 and 24 reduce the vibrations and improve the stability of the bar 18.

In an alternative that is not shown, the indicator lights V are directly integrated into the console 14.

According to another alternative that is not shown, the safety bar is made from a translucent material, in particular polymethyl methacrylate (Plexiglas, registered trademark) in order to be able to diffuse light. In particular, the safety bar 18 can be a light-emitting tube containing a set of light-emitting diodes positioned at regular intervals along its main axis. The lighted signal member is therefore the safety bar 18 as a whole, which increases the visibility of the light signal. Furthermore, several colors can be used for signaling, each color corresponding to a position of the bar 18. Thus, the operator easily makes the cognitive connection between the color of the safety bar 18 and his position.

According to another alternative, only the indicator 22 lights up during tilting of the bar 18 and remain lit over the rest of the travel.

According to another alternative that is not shown, the safety bar 18 is mounted sliding relative to the console 14. For example, the bar 18 can be pushed in like a drawer in a housing of the console when it is pressed on. Similarly to a tilting connection, the translation of the safety bar 18 first causes activation of the warning device M2, then activation of the safety device Ml.

According to another alternative that is not shown, the warning means further comprise or can be summarized by a sound warning, suitable for emitting a predetermined sound when the safety bar 18 is in its intermediate position. Consequently, if the operator O does not have his eyes fixed on the safety bar 18 and therefore does not see the orange indicator light 22, he is nevertheless warned that he is pressing on the safety bar 18.

According to another alternative that is not shown, when the safety bar 18 reaches its intermediate position, it sends a signal to the electronic control unit to slow all movements of the platform 10. For example, the movement speed of the platform 10 can be cut in half. In this way, a collision between the beam P and the operator O first causes the platform 10 to move, which makes it possible to limit crushing of the operator O in the case of collision.

The alternatives and embodiments described above can be combined to yield new embodiments of the invention.

The invention claimed is:

1. An aerial lift comprising a chassis equipped with means for moving over a ground surface, a mast, a platform supported by the mast, a control console mounted on the platform and comprising control means for controlling movements of the platform, and a safety bar mounted so as to tilt or slide relative to the console, designed to control the operation of the control means, and provided to assume:

a first idle position where the safety bar does not prevent the operation of the control means, and a second position where the safety bar inhibits the operation of the control means, characterized in that, when the safety bar tilts or slides between the first idle position and the second position, the safety bar assumes an intermediate position where it does not prevent the operation of the control means and where it activates warning means.

2. The aerial lift according to claim 1, wherein the aerial lift includes at least one signal member.

3. The aerial lift according to claim 2, wherein the aerial lift includes three signal lights.

4. The aerial lift according to claim 3, wherein the signal lights are integrated into the safety bar.

5. The aerial lift according to claim 4, wherein the safety bar is made at least partially from a transparent or translucent material.

6. The aerial lift according to claim 3, wherein the signal lights are integrated into the control console.

7. The aerial lift according to claim 2, wherein a first signal light in a first color is activated when the safety bar is in its first idle position, a second signal light in a second color is activated when the safety bar is in its second position, and a third signal light in a third color, belonging to the warning means, is activated when the safety bar is in its intermediate position.

8. The aerial lift according to claim 1, wherein the warning means comprise an audible warning, suitable for emitting a predetermined sound when the safety bar is in the intermediate position.

9. The aerial lift according to claim 1, wherein the movements of the platform are slowed when the safety bar is in its intermediate position.

10. The aerial lift according to claim 1, wherein the safety bar is U-shaped and wherein the tilting or sliding of the safety bar between its first idle position and its second position is done toward the outside of the platform relative to the location of an operator in position to manipulate the control means.

11. The aerial lift according to claim 1, wherein the aerial lift comprises means for detecting the tilting or sliding of the safety bar that controls the operation of the control means.

* * * * *